US006485382B1

(12) United States Patent
Chen

(10) Patent No.: US 6,485,382 B1
(45) Date of Patent: Nov. 26, 2002

(54) BAT HAVING FIBER/RESIN HANDLE AND METAL HITTING MEMBER AND METHOD OF MAKING

(76) Inventor: Sam Chen, 7057 Florey St., San Diego, CA (US) 92122

( * ) Notice: Subject to any disclaimer, the term of this patent is extended or adjusted under 35 U.S.C. 154(b) by 0 days.

(21) Appl. No.: 09/801,525

(22) Filed: Mar. 9, 2001

(51) Int. Cl.[7] ..... A63B 59/06
(52) U.S. Cl. ..... 473/566; 473/567
(58) Field of Search ..... 473/566, 567, 473/457, 519, 520

(56) References Cited

U.S. PATENT DOCUMENTS

| | | | | | |
|---|---|---|---|---|---|
| 3,877,698 | A | | 4/1975 | Volpe | 273/72 R |
| 3,963,239 | A | | 6/1976 | Fujii | 273/72 A |
| 4,014,542 | A | * | 3/1977 | Tanikawa | 473/567 |
| 4,025,377 | A | | 5/1977 | Tanikawa | 156/242 |
| 4,063,732 | A | * | 12/1977 | Scott et al. | 403/379.2 |
| 4,546,976 | A | * | 10/1985 | Jones | 273/DIG. 8 |
| 4,569,521 | A | | 2/1986 | Mueller | 273/72 A |
| 5,094,453 | A | | 3/1992 | Douglas et al. | 273/72 A |
| 5,114,144 | A | | 5/1992 | Baum | 273/72 R |
| 5,219,164 | A | * | 6/1993 | Peng | 473/520 |
| 5,301,940 | A | | 4/1994 | Seki et al. | 273/72 R |
| 5,364,095 | A | | 11/1994 | Easton et al. | 273/72 A |
| 5,409,214 | A | | 4/1995 | Cook | 273/72 R |
| 5,415,398 | A | | 5/1995 | Eggiman | 273/725 A |
| 5,421,572 | A | | 6/1995 | MacKay, Jr. | 273/72 A |
| 5,458,330 | A | | 10/1995 | Baum | 273/72 R |
| 5,460,369 | A | | 10/1995 | Baum | 273/72 R |
| 5,533,723 | A | | 7/1996 | Baum | 273/72 R |
| 5,624,115 | A | | 4/1997 | Baum | 473/567 |
| 5,722,908 | A | * | 3/1998 | Feeney et al. | 473/566 |
| 5,827,142 | A | * | 10/1998 | Rappaport | 473/567 |
| 5,961,405 | A | | 10/1999 | MacKay, Jr. | 473/566 |
| 5,967,914 | A | | 10/1999 | Tanaka | 473/566 |
| 6,036,610 | A | | 3/2000 | Lewark | 473/564 |
| 6,053,828 | A | | 4/2000 | Pitsenberger | 473/566 |
| 6,099,422 | A | * | 8/2000 | Rappaport et al. | 473/567 |

FOREIGN PATENT DOCUMENTS

JP 6-91026 * 6/1994

OTHER PUBLICATIONS

Green, "S.D. Firm May Have Cure for Broken Bats", *San Diego Union–Tribune*, Nov. 16, 2000, pp. A1, A12.

* cited by examiner

*Primary Examiner*—Mark S. Graham
(74) *Attorney, Agent, or Firm*—Calif Tervo

(57) ABSTRACT

A bat (10) comprises a near portion (20) and a far portion (80) joined by a weld (90). Near portion (20) generally comprises a fiber/resin composite portion (30) including a proximal end (32), a distal end (40), and a grip portion (36) therebetween, and a metal joining ring (50) including a proximal portion (54) including interlocking joining means (55), such as through bores (56) or contours (57), mechanically joining proximal portion (54) of ring (50) to distal end (40) of composite portion (30), and a distal portion (58). Far portion (80) includes a proximal portion (82) joined, such as by weld (90), to ring (50), a distal portion (87), and a barrel portion (86) therebetween.

20 Claims, 1 Drawing Sheet

BAT HAVING FIBER/RESIN HANDLE AND METAL HITTING MEMBER AND METHOD OF MAKING

FIELD OF THE INVENTION

This invention relates in general to a sporting bat, such as a baseball bat, and more specifically involves a bat having a fiber/resin composite handle and a metal hitting barrel, such as of aluminum, and a method of manufacture.

BACKGROUND OF THE INVENTION

Conventional bats are predominately either made entirely of wood or of aluminum. Wooden bats break more easily and wear out faster than aluminum bats. Aluminum bats are harder-hitting and longer-lasting than wooden bats, but transmit more shock to the batter such that a batter's hands and arms can be numbed.

Bats of other materials and multiple materials have been proposed to overcome the shortcomings of traditional bats, but, for various reasons, none have replaced the traditional bats. Bats of multiple materials tend to be more difficult to produce and, thus, are more expensive. Also, there is often an engineering problem and a production problem with joining dissimilar materials.

Therefore, it is desirable to produce a bat that overcomes the shortcomings of conventional bats, is durable, and is still easy to produce.

DETAILED DESCRIPTION OF THE INVENTION

Figure 1:
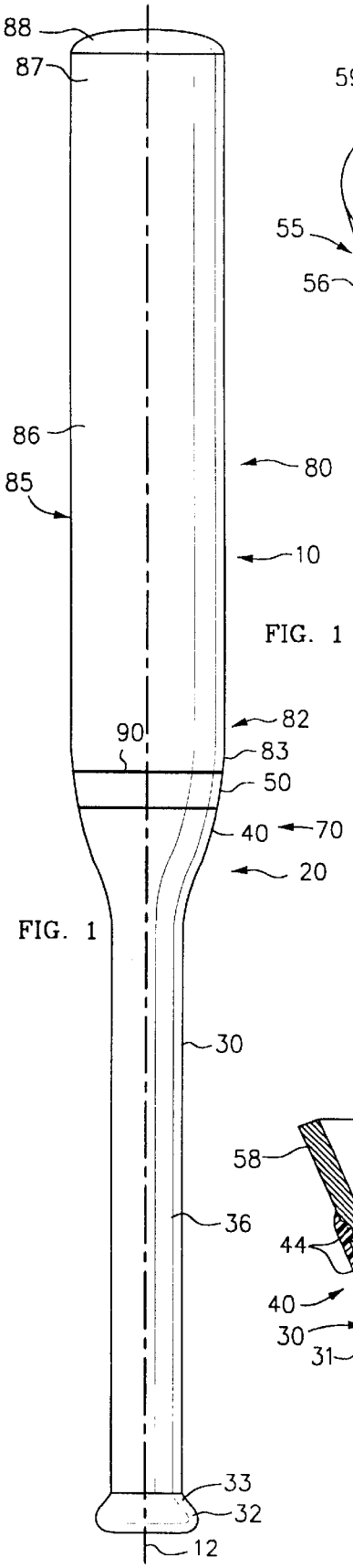
FIG. 1 is a side elevation view of a preferred embodiment of a bat according to the invention.
Figure 2:
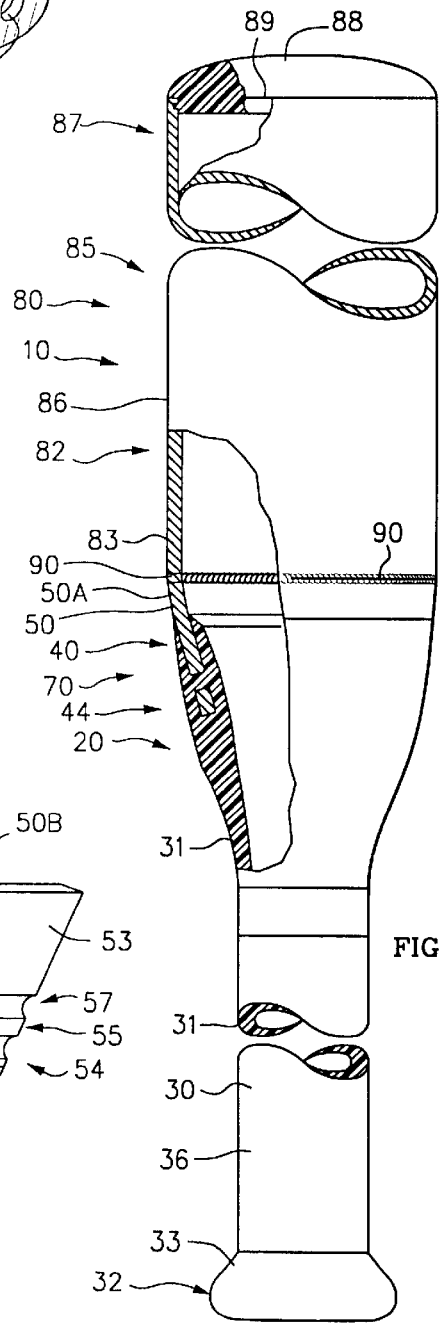
FIG. 2 is an enlarged, partially cut away, side elevation view of the bat of FIG. 1.

FIG. 1 is a side elevation view of a preferred embodiment of a bat 10 according to the invention. FIG. 2 is an enlarged, partially cut away, side elevation view of bat 10 of FIG. 1. Bat 10 generally comprises a near portion 20 for holding by a batter and a far portion 80 for hitting a ball. Bat 10 is elongate and has a longitudinal axis 12 about which bat 10 is radially symmetrical.

Near portion 20 generally includes a fiber/resin composite portion 30 and a metal joining element, such as ring 50. Composite portion 30 includes a proximal end 32 terminating in a knob 33, a distal end 40, and a grip portion 36 therebetween. Fiber/resin composite portion 30 may be constructed of fiber materials well-known in the art, either singly or in conjunction with one another, including: inorganic or metal fibers, such as glass, carbon, ceramic, boron, tungsten, molybdenum, or steel; or organic fibers, such as polyamide, polyvinyl alcohol, aramid, and polyester. A typical carbon fiber, A54, has a tensile strength of 450K PSI, a modulus of elasticity of 32M PSI, and elongation-to-failure of 125%. A typical aramid fiber, Kevlar 49 (Dupont), has a tensile strength of 525K PSI, an elastic modulus of 18M PSI, and an elongation-to-failure of 440%. Composite portion 30 may include N7 cross-linked matrix resin material as is well-known in the art including thermosetting resin, such as vinyl ester or polyester, or an epoxy (amine, anhydride, or bisphenol-A).

Composite portion 30 may be tailored to optimize the desired performance parameters for a specific batter. Stiffness, bending, vibration damping, strength, hardness, weight, and other qualities can be modified. Fiber types and orientation, overall size and wall thickness, and resin types and curing methods can be altered.

The an isotropic nature of composite materials, unlike the generally isotropic properties of metal alloys, makes composite material ideal for use as a bat handle such that lighter, stronger handles, and with desired characteristics may be fabricated. Composite portion 30 can also simulate wood without the undesirable characteristic of breaking.

As best seen in FIG. 2, in the preferred embodiment, composite portion 30 is a relatively thin walled shell 31 having a generally cylindrical shape of varying diameter. Grip portion 36 is dimensioned for gripping by a batter. Knob 33 is radially enlarged from grip portion 36 and helps prevent bat 10 from slipping from the batter's hands. Knob 33 may be an integral part of shell 31, as illustrated, or may be fabricated separately and added on later, depending upon the construction technique employed. Distal end 40 includes interlocking joining means 44, which mechanically interlocks with ring 50 as will be described shortly.

Figure 3:
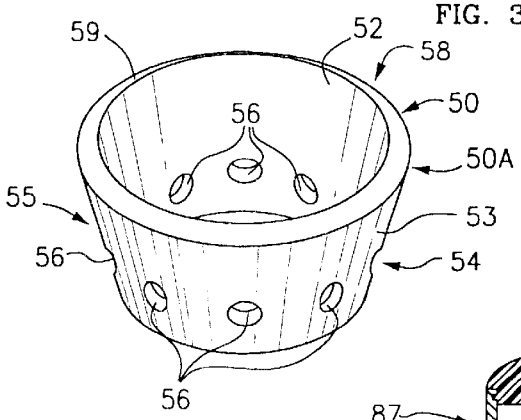
FIG. 3 is an enlarged perspective view of the first preferred embodiment of a metal ring of FIG. 2.
Figure 4:
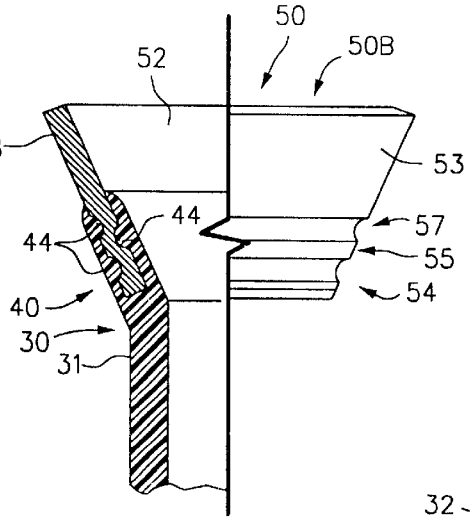
FIG. 4 is a side elevation view of a second preferred embodiment of a metal ring.

FIGS. 3 and 4 are exemplary embodiments of ring 50. FIG. 3 is an enlarged perspective view of the first preferred embodiment, ring 50A, of ring 50 of FIG. 2. FIG. 4 is a side elevation view of a second preferred embodiment, ring 50B of ring 50, shown partially in cross-section attached to composite portion 30.

Ring 50 is made of metal, such as aluminum alloy, typically of the same type of metal as is far portion 80. Ring 50A of FIGS. 2 and 3 is a tapered, truncated conical shell having an inner surface 52, an outer surface 53, a proximal portion 54 and a distal portion 58. Proximal portion 54 includes interlocking joining means 55, such as through bores 56, for mechanically joining proximal portion 54 of ring 50A to interlocking joining means 44, such as composite material extending through bores 56 on distal end 40 of composite portion 30, as best seen in cut-away in FIG. 2. Adhesion of the resin to surfaces of ring 50 and shell 31 cooperates with this mechanical joining to produce a bond capable of withstanding the spiking stress forces generated by hitting a ball.

Distal portion 58 of ring 50A includes an end 59 adapted for attachment by suitable means, such as by welding, pinning, epoxy, press fit or interlocking, to far portion 80.

Ring 50B of FIG. 4 is a tapered, truncated conical shell having an inner surface 52, an outer surface 53, a proximal portion 54 and a distal portion 58. Proximal portion 54 includes interlocking joining means 55, such as surface contours 57, for mechanically joining proximal portion 54 of ring 50B to interlocking joining means 44, such as composite material extending into contours 57, on distal end 40 of composite portion 30, as best seen in cut-away in FIG. 4. Adhesion of the resin to surfaces of ring 50 and shell 31 cooperates with this mechanical joining to produce a bond capable of withstanding the spiking stress forces generated by hitting a ball. Preferably, ring 50 is part of the transition portion 70 between grip portion 36 and hitting portion 85 wherein bat 10 flares out from grip portion 36 to the larger-diameter hitting portion 85. However, ring 50 could be part of the larger diameter hitting portion 85, wherein some or all of the transition portion 70 would be part of composite portion 30.

Distal portion 58 of ring 50B includes an end 59 adapted for attachment by suitable means, such as by welding, pinning, epoxy, press fit or interlocking, to far portion 80.

Far portion 80 is of metal, such as aluminum or aluminum alloy, such as 7000 series alloys such as Alcoa CU-31, 7046, 7178 and C405. Other metals and alloys are contemplated, including steel, titanium, and nickel alloys. Far portion 80 includes a proximal portion 82, a distal end 87, and barrel portion 86 therebetween for hitting a ball. The entire far portion 80, or at least barrel portion 86, may be a cylindrical tube. Far portion 80 may be made in other manners well-known in the art. Proximal portion 82 includes an end 83 adapted for joining, such as by circumferential weld 90, to distal portion 58 of ring 50, such as to end 59. An end cap 88 includes a plug portion 89 for insertion into central cavity of distal end 87.

Composite portion 30 can be fabricated in any desired of several methods well-known in the art, such as internal bladder compression molding technique, injection molding, resin injection or even hand lay-up. Ring 50 can be attached to distal end 44 of composite portion in a manner as would be known to one skilled in the art depending upon the general method of fabrication used.

Near portion 20 is then joined to far portion 80 by suitable means such as pinning, epoxy, press fit, interlocking or welding distal portion 58 of ring 50 to proximal portion 82 of far portion 80. Welding can be performed by any suitable technique including fusion welding.

From the foregoing description, it is seen that the present invention provides a superior bat and a novel method of efficiently manufacturing the bat.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A bat comprising:

a near portion comprising:
- a fiber/resin composite portion including:
  - a proximal end;
  - a distal end; and
  - a grip portion therebetween;
- a metal joining element including:
  - interlocking joining means mechanically joining said metal joining element to said distal end of said composite portion; and a far portion of metal including:
- a proximal portion joined to said metal joining element;
- a distal portion; and
- a barrel portion therebetween.

2. The bat of claim 1 wherein said composite portion is a shell.

3. The bat of claim 1 wherein said proximal end of said composite portion includes a knob.

4. The bat of claim 1 wherein said interlocking joining means of said metal joining element includes surface contours.

5. The bat of claim 1 wherein said interlocking joining means of said metal joining element includes through bores.

6. The bat of claim 1 wherein said metal joining element is a ring.

7. The bat of claim 6 wherein said interlocking joining means of said ring includes contours.

8. The bat of claim 6 wherein said interlocking joining means of said ring includes through bores.

9. The bat of claim 1 wherein:

said composite portion is a shell;

said proximal end of said composite portion includes a knob;

said metal joining element is a tapered ring;

said interlocking joining means of said ring includes contours or through bores; and said barrel portion is substantially cylindrical.

10. A method of making a bat comprising the steps of fabricating a near portion comprising the steps of:
- providing a metal joining element including interlocking joining means;
- molding a fiber/resin composite portion having: a proximal end; a distal end; and a grip portion therebetween; such that the distal end of the composite portion is interlockingly joined to the interlocking joining means of the metal joining element;

providing a far portion having:
- a proximal portion;
- a distal portion; and
- a barrel portion therebetween; and joining the metal joining element of the near portion to the proximal portion of the far portion.

11. The method of claim 10 wherein said composite portion forms a shell.

12. The method of claim 10 wherein the proximal end of said composite portion includes a knob.

13. The method of claim 10 wherein the interlocking joining means of the metal joining element includes surface contours.

14. The method of claim 10 wherein the interlocking joining means of the metal joining element includes through bores.

15. The method of claim 10 wherein:

the composite portion forms a shell;

the proximal end of the composite portion includes a knob;

the metal joining element is a tapered ring;

the interlocking joining means of the ring includes contours or through bores; and the barrel portion is substantially cylindrical.

16. A method of fabrication of a bat comprising the steps of providing a near portion having:
- a metal joining element including interlocking joining means; and
- a fiber/resin composite portion having: a proximal end; a distal end; and a grip portion therebetween; the distal end of the fiber/resin composite portion being joined to the joining means of the metal joining element by interlocking with the locking means;

providing a far portion having:
- a proximal portion;
- a distal portion; and a barrel portion therebetween;

joining the metal joining element of the near portion to the proximal portion of the far portion.

17. The method of claim 16 wherein the proximal end of said composite portion includes a knob.

18. The method of claim 16 wherein the interlocking joining means of the metal joining element includes surface contours.

19. The method of claim 16 wherein the interlocking joining means of the metal joining element includes through bores.

20. The method of claim 16 wherein:

the composite portion forms a shell;

the proximal end of the composite portion includes a knob;

the metal joining element is a tapered ring;

the interlocking joining means of the ring includes contours or through bores; and the barrel portion is substantially cylindrical.

* * * * *